US006475619B2

(12) United States Patent
Goldberg

(10) Patent No.: US 6,475,619 B2
(45) Date of Patent: Nov. 5, 2002

(54) STIFFENER MATERIAL WITH SELF ADHESIVE PROPERTIES

(75) Inventor: Bruce Goldberg, Clifton, NJ (US)

(73) Assignee: Stanbee Company, Inc., NJ (US)

( * ) Notice: Subject to any disclaimer, the term of this patent is extended or adjusted under 35 U.S.C. 154(b) by 0 days.

(21) Appl. No.: 10/023,292

(22) Filed: Dec. 18, 2001

(65) Prior Publication Data

US 2002/0091176 A1 Jul. 11, 2002

Related U.S. Application Data

(62) Division of application No. 09/631,503, filed on Aug. 3, 2000, now Pat. No. 6,391,380.

(51) Int. Cl.[7] ..... D02J 3/00
(52) U.S. Cl. ..... 428/375
(58) Field of Search ..... 428/375

(56) References Cited

U.S. PATENT DOCUMENTS

| | | | | |
|---|---|---|---|---|
| 749,267 | A | | 1/1904 | Davis |
| 2,277,941 | A | | 3/1942 | Almay |
| 2,541,748 | A | | 2/1951 | Daly |
| 2,541,761 | A | | 2/1951 | Harrison |
| 2,569,764 | A | | 10/1951 | Jonas |
| 2,572,184 | A | | 10/1951 | Newton, Jr. |
| 2,611,726 | A | | 9/1952 | Harrison |
| 2,616,821 | A | | 11/1952 | Harrison |
| 2,639,240 | A | | 5/1953 | Ehle |
| 2,684,540 | A | | 7/1954 | Levy |
| 2,734,289 | A | | 2/1956 | Heaton et al. |
| 2,738,600 | A | | 3/1956 | Shultz |
| 2,758,045 | A | | 8/1956 | Heaton et al. |
| 2,760,884 | A | | 8/1956 | Graf, Jr. |
| 2,805,962 | A | | 9/1957 | Hendricks |
| 2,923,641 | A | | 2/1960 | Graf, Jr. |
| 3,264,272 | A | | 8/1966 | Rees |
| 3,518,221 | A | | 6/1970 | Kenyon et al. |
| 3,708,332 | A | * | 1/1973 | Closson, Jr. ..... 428/339 |
| 3,773,708 | A | | 11/1973 | Takahashi et al. |
| 3,778,251 | A | | 12/1973 | Trask |
| 3,956,230 | A | | 5/1976 | Gaylord |
| 3,961,124 | A | | 6/1976 | Matton |
| 4,069,532 | A | | 1/1978 | Rossitto et al. |
| 4,151,155 | A | | 4/1979 | Chaplick |
| 4,211,691 | A | | 7/1980 | FitzGerald et al. |
| 4,308,673 | A | | 1/1982 | Mobius |
| 4,350,732 | A | | 9/1982 | Goodwin |
| 4,717,496 | A | | 1/1988 | Brehmer et al. |
| 5,807,968 | A | | 9/1998 | Heinrich et al. |

FOREIGN PATENT DOCUMENTS

| | | |
|---|---|---|
| GB | 1065418 | 4/1967 |
| GB | 2091768 | 4/1982 |
| GB | 2102851 | 2/1983 |
| JP | 2-107203 | 4/1990 |

* cited by examiner

*Primary Examiner*—Erma Cameron
(74) *Attorney, Agent, or Firm*—Anthony J. Casella; Gerald E. Hespos

(57) ABSTRACT

A process of making a fabric based stiffener material having thermal adhesive properties on its top and bottom surfaces which is based on (a) contacting a non-woven fabric with a latex forming resin and a finely divided powder adhesive polymer to form a latex saturated non-woven fabric; and (b) removing the excess latex from the non-woven fabric formed in step (a); and (c) drying the product of step (b).

4 Claims, No Drawings

STIFFENER MATERIAL WITH SELF ADHESIVE PROPERTIES

This application is a divisional of U.S. patent appl. No. 09/631,503 filed Aug. 3, 2000 now U.S. Pat. No. 6,391,380.

BACKGROUND OF THE INVENTION

1. Field of the Invention

The present invention is concerned with stiffener materials for use in the fabrication of shoes and for making other articles.

2. Description of the Related Art

Stiffener materials traditionally are used in the shoe industry to provide varying degrees of resilient, stiffness, and shape-retention to the heel and toe portions of shoes. These materials have been made of either a needle punched non-woven fabric which is saturated with a latex resin composition or a flexible thermoplastic resin that is extruded or powder coated onto a woven fabric or extruded into a sheet. If a non-woven fabric is employed, the typical material which is selected is a polyester mat made from fibers having a denier of between 3 and 6 deniers or mixtures of such fibers. The latex resin compositions may be based on resins selected from styrene resins, styrene-butadiene resins, vinyl acetate resins, vinyl chloride resins or acrylic resins. The extruded thermoplastic or powder coated thermoplastic materials may be selected from the group consisting of polyvinyl chloride, ionomers, high, medium or low density polyethylene, polypropylene, polyesters, polystyrene and copolymers and compatible blends of such polymers. After the initial coating of the woven or non-woven fabrics, a separate hot melt coating operation is carried out to provide a finished stiffener which has self adhesive properties which are sufficient to bond the stiffener to an inner layer and an outer layer of a manufactured article.

The powder-coated resins usually contain particles which measure from about 100 to about 590 microns which prevents the particles from passing through the woven fabrics during the coating operation.

A typical non-woven latex saturated stiffener is made with a polymer latex wherein the dispersed polymer particles have an average latex particle size of less than one micron and a filler such as calcium carbonate which has an average particle size of less than 10 microns. A continuous sheet of the non-woven fabric may be passed through a bath containing the latex composition to saturate the non-woven fabric prior to passing the saturated sheet through calendaring rolls, which are spaced apart with a filer gauge, in order to remove excess latex composition. The saturated non-woven fabric is then clipped onto a tenter frame and passed to a drying oven to remove the water from the latex composition. The dried non-woven fabric is then sized by passing the dried latex saturated non-woven fabric through calendar rolls and wound on a beam. The product may be made heavier, thinner, stiffer or more flexible depending on the weight and thickness of the non-woven fabric, the amount of the latex applied and the formulation of the latex.

Since the dried non-woven fabric has no adhesive properties after the application of the latex and the oven drying, it is necessary to apply a hot melt adhesive, such as a ethylene vinylacetate hot melt adhesive. This results in a product that can be heat activated to provide a finished stiffener which has self adhesive properties which are sufficient to bond the stiffener to an inner layer and an outer layer of a shoe.

U.S. Pat. No. 4,717,496 describes a method of making a stiffening material with non-latex powders. The disclosure of U.S. Pat. No. 4,717,496 is incorporated by reference.

SUMMARY OF THE INVENTION

The present invention provides a novel process that produces a novel stiffener material which is made by adding an effective amount of a finely divided thermally activatable powder adhesive to a latex composition which is used to saturate a non-woven fabric to make a stiffener material.

The process of the invention comprises a method of making a fabric based stiffener material having thermal adhesive properties on its top and bottom surfaces, said process comprising:

(a) preparing a coating composition which comprises a latex forming resin and a finely divided powdered adhesive polymer;

(b) contacting a non-woven fabric with the composition of step (a) to form a latex saturated non-woven fabric;

(c) removing the excess latex from the non-woven fabric; and (d) drying the product of step(c).

Accordingly, it is a primary object of the invention to provide a process where a treating composition comprising a latex based stiffening resin and a heat activated adhesive resin is used to saturate a non-woven fabric to form a treated fabric and thereafter drying and sizing said treated fabric to make a heat activated adhesive stiffener having adhesive properties on both sides of the stiffener material.

It is also an object of the invention to provide a novel heat activated stiffener material which has adhesive material on the surface and on the interior of the stiffener material.

It is also an object of the invention to eliminate the need to carry out a separate adhesive coating operation whereby an adhesive is applied as a separate manufacturing step to a stiffener which is prepared by a latex coating a non-woven fabric.

It is also an object of the invention to provide a novel polyester containing latex composition which provides a stiffener having a good combination of stiffness, shape-retention, and resiliency.

These and other objects and features of the invention will become apparent from a review of the following detailed description.

DETAILED DESCRIPTION OF THE INVENTION

While woven or non-woven fabrics may be used in the practice of the invention, it is preferred to employ a non-woven fabric that is made with fibers having a denier of about 6 to about 15 or fabrics made with a blend of such fibers. It is especially preferred to use a non-woven fabric made with fibers that are a 70/30 blend of 15 and 6 denier fibers. If fabrics are used that are made with deniers substantially different than the above described results, difficulty can arise when using the latex containing the adhesive and the polymer material.

The polyester containing latex composition is prepared by taking a conventional latex of a material such a styrene butadiene, an acrylic polymer, a vinyl acetate resin, a vinyl chloride resins or other suitable latex forming polymer and adding an amount of a polyester powder which is sufficient to impart good adhesive properties to the finished stiffener material. Saturated powdered polyesters such as polycaprolactone, azelaic, adipic, sebacic and copolymers of polyethylene terephthalate and the like may be employed as substantially pure resins or in the form of commercially formulated adhesive compositions with conventional dispersants, tackifiers, stabilizers, fillers and the like. If the polyester is employed as a pure resin, conventional dispersants such as non-ionic surfactants, gums, colloids or thickening agents may be added to stabilize the latex containing the polyester. In order to provide an adhesive which adheres to the non-woven fabric without "dropping out" or in other words separating as a discrete powder on the non-woven fabric, it is preferred to grind the powdered polyester to a finely divided state which will remain dispersed on the non-woven fabric when it is applied from a dispersion in a polymeric latex. Generally an average particle size of less than 150 microns and more preferably less than 100 microns will provide good results. The "dropping out" phenomenon is usually observed when the process of the invention is practiced on a full scale commercial apparatus as compared to a laboratory scale operation. Ammonium chloride or other acid forming ingredients may be employed as a catalyst to cross-link certain polymer latex resins. It is preferred to add an effective amount of an organic cross-linking agent to the polyester containing latex to improve resilience and prevent "washing out" of the latex. Melamine-formaldehyde condensates are preferred. Suitable examples of these materials are described in U.S. Pat. No. 2,871,213 and U.S. Pat. No. 3,215,647, which are incorporated by reference. If a cross-linker is used, a total of 1.0% to 2.0% by weight may be used. Compatible fillers such as finely calcium carbonate, and the like may be employed.

The novel stiffener may be evaluated to determine the adhesive bonding strength of the finished product by die cutting a piece of the stiffener to be tested and inserting the stiffener between two pieces of a non-woven lining material that is a 35% poly ester blend having a thickness of 0.029 inches. The three pieces are held together and placed into a back part heel counter molding machine with the female mold at 180° F. and the male mold at 290° F. The mold is closed and held in position for 17 seconds, The mold is opened and the laminate is placed, at room temperature, in a laminate cooling station having the desired shape of the final product. The shaped heel counter is now rigid and the stiffener is bonded to the two pieces of non-woven lining material. The adhesive test requires that the three part laminate remain bonded together when manual pressure is applied to pull the components apart. The resiliency test is based on making a thumb indent on the side of the heel counter and evaluating the degree which the indent bounces back. An acceptable bounce is when the indent bounces back immediately with a "ping-pong" sound.

The latex of the invention will comprise the following formulation:

| | |
|---|---|
| latex forming polymer dry basis | 15 wt % to 35 wt % |
| dispersant | 0.4 wt % to 1.0 wt % |
| adhesive polymer | 10 wt % to 21 wt % |
| water | 35 wt % to 50 wt % |
| filler | 0 wt % to 15 wt % |

Generally the preferred latex formulations will comprise the following formulation:

| | |
|---|---|
| latex forming polymer dry basis | 29.5 wt % to 35 wt % |
| dispersant | .7 wt % to .9 wt % |
| adhesive polymer | 15 wt % to 19 wt % |
| water | 43 wt % to 44 wt % |

-continued

| | |
|---|---|
| filler | 1.1 wt % to 11.8 wt % |

The non-woven fabric should be saturated with an amount of the latex formulation that will result in a dry weight gain of between 300 to 1000 g/meter$^2$ of coated fabric and preferably between 400 to 900 g/meter$^2$ of based on the dry weight of the coated fabric after the coating and drying operation as compared to the dry weight of the uncoated fabric. The preferred drying conditions are a temperature of from 200 to 400° F. and preferably from 250° F. to 370° F. which are applied for a period of 5 to 15 minutes in a tenter frame equipped thermostatically controlled oven.

DESCRIPTION OF THE PREFERRED EMBODIMENTS

The following examples are added to illustrate the invention. They are not to be construed as limitations on the scope of the invention.

EXAMPLE 1

A formulation was made by adding the ingredients in sequence using a laboratory propeller agitator:

| | |
|---|---|
| Styrene-butadiene copolymer (Dow 242 SBR on resin-49% solids; particle size 1750 Angstroms; Brookfield visc. #2–50 rpm = 70; Tg 45° C.)) | 318.0 g |
| Melamine-formaldehyde condensate cross-linker (cyrez 933; CAS. No. 88002-20-01) | 8.0 g |
| Water | 68.0 g |
| Oxazolidine surfactant (Alkaterge T-IV wt av mol wt 545 CAS No. 95706-86-8) | 3.0 g |
| Polyepsiloncaprolactone-88 micron av. dia. (Tone 767-MFI ASTM-D1238-73 1.9 at 80° C., 44 psi, g/10 min. mp. 140° C.; shore hardness 55D) | 67 g |
| Calcium carbonate (median particle dia. 6.5 $\mu$; Omyacarb 6) | 46 g |
| Ammonium chloride | 3 g |
| Aqueous Soln. Sod. polyacrylate (Alcogum 296; Brookfield vis. 20 rpm, 25° C. 20,000–30,000 cs; 14.7–17.3% solids) | 14.5 g |
| Total mix Viscosity-Brookfield-3spindle-20 rpm-25° C. | 2050 cps |
| % polyester based on total weight of solids - 25% | |
| % polyester based on total weiqht of resin - 30% | |

This formulation applied to a non-woven fabric, 166 g/m2, which was made from a 70/30 blend of 15 and 6 denier fibers. The fabric was provided on a continuous roll. 60" wide which was passed through a trough to saturate the fabric prior to passing the fabric through a set of steel rolls that were 76" wide and 9" in diameter with an opposing hydraulic pressure of 500–600psi. After passing through the rolls, the fabric was dried in an oven 85 ft. long at a temperature of 130–200° C. and wound on a reel at a speed of 3.25 yards/minute. The product produced had good resiliency and a fair bond.

EXAMPLE 2

A formulation was made by adding the ingredients in sequence using a laboratory propeller agitator:

| | |
|---|---|
| Styrene-butadiene copolymer (Dow 242 SBR on resin-49% solids; particle size 1750 Angstroms; Brookfield visc. #2–50 rpm = 70; Tg 45° C.)) | 260.0 g |
| Melamine-formaldehyde condensate cross-linker (cyrez 933; CAS. No. 88002-20-01) | 8.0 g |
| Water | 75.0 g |
| Oxazolidine surfactant (Alkaterge T-JV VA av mol wt 545 CAS. No. 95706-86-8) | 4.0 g |
| Polyepsiloncaprolactone-88 micron av. dia. (Tone 767-MFI D1238-73 1.9–80° C., 44 psi, g/10 min. mp. 140° C.; shore hardness 55D) | 85 g |
| Calcium carbonate (median particle dia. 6.5 $\mu$; Omyacarb 6) | 0 g |
| Aqueous Soln. Sod. polyacrylate (Alcogum 296; Brookfield vis. 20 rpm, 25° C. 20,000–30,000 cPs; 14.7–17.3% solids) | 22 g |
| Ammonium chloride | 4 g |
| Total mix Viscosity-Brookfield-3spindle-20 rpm-25° C. | 2100 cps |
| % polyester based on total weight of solids 37.7% | |
| % polyester based on total weight of resin 40% | |

This formulation applied to a non-woven fabric, 166 g/m2, which was made from a 70/30 blend of 15 and 6 denier fibers. The fabric was provided on a continuous roll. 60" wide which was passed through a trough to saturate the fabric prior to passing the fabric through a set of steel rolls that were 76" wide and 9" in diameter with an opposing hydraulic pressure of 500–600psi. After passing through the rolls, the fabric was dried in an oven 85 ft. long at a temperature of 130–200° C. and wound on a reel at a speed of 3.25 yards/minute. The product produced has a very good bond and good resiliency.

EXAMPLE 3

A formulation was made by adding the ingredients in sequence using a laboratory propeller agitator:

| | |
|---|---|
| Styrene-butadiene copolymer (Dow 242 SBR on resin-49% solids; particle size 1750 Angstroms; Brookfield visc. #2–50 rpm = 70; Tg 45° C.)) | 227.0 g |
| Melamine-formaldehyde condensate cross-linker (cyrez 933; CAS. No. 88002-20-01) | 7.0 g |
| Water | 92.0 g |
| Oxazolidine surfactant | 4.0 g |

-continued

| | |
|---|---|
| (Alkaterge T-IV wt av mol wt 545 CAS. No. 95706-86-8) | |
| Polyepsiloncaprolactone-88 micron av. dia. (Tone 767-MFI D1238-73 1.9–80° C., 44 psi, g/10 min. mp. 140° C.; shore hardness 55D) | 91 g |
| Calcium carbonate (median particle dia. 6.5; Omyacarb 6) | 62 g |
| Aqueous Soln. Sod. polyacrylate (Alcogum 296; Brookfield vis. 20 rpm, 25° C. 20,000–30,000 cPs; 14.7–17.3% solids) | 14 g |
| Total mix Viscosity Brookfiled-3spindle-20 rpm-25° C. | 1850 cps |
| % polyester based on total weight of solids 34.5% | |
| % polyester based on total weight of resin 45% | |

This formulation applied to a non-woven fabric at a level of 166 g/m2. The non-woven fabric was made from a 70/30 blend of 15 and 6 denier fibers. The fabric was provided on a continuous roll. 60" wide which was passed through a trough to saturate the fabric prior to passing the fabric through a set of steel rolls that were 76" wide and 9" in diameter with an opposing hydraulic pressure of 500–600psi. After passing through the rolls, the fabric was dried in an oven 85 ft. long at a temperature of 130–200° C. and wound on a reel at a speed of 3.25 yards/minute. The product produced had good resiliency and a good bond.

What is claimed is:

1. A stiffener comprising a non-woven fabric saturated with a composition comprising:

| | |
|---|---|
| latex forming polymer | 15 wt % to 35 wt % |
| dispersant | 0.4 wt % to 1.0 wt % |
| powder adhesive polyester resin | 10 wt % to 50 wt % |
| water | 35 wt % to 50 wt %; and |
| filler | 0 wt % to 15 wt %. |

2. A stiffener as defined in claim 1, wherein the latex forming polymer is styrene butadiene and the adhesive polyester resin is poly-epsilon caprolactone.

3. A stiffener as defined in claim 1, wherein the fabric is a non-woven fabric comprised of 15 denier fibers.

4. A stiffener as defined in claim 1, wherein the adhesive polyester resin is formed from a powder with a particle size less than 100 microns.

* * * * *